US010516961B2

(12) United States Patent
Laaksonen

(10) Patent No.: US 10,516,961 B2
(45) Date of Patent: Dec. 24, 2019

(54) PREFERENTIAL RENDERING OF MULTI-USER FREE-VIEWPOINT AUDIO FOR IMPROVED COVERAGE OF INTEREST

(71) Applicant: Nokia Technologies Oy, Espoo (FI)

(72) Inventor: Lasse Juhani Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/462,063

(22) Filed: Mar. 17, 2017

(65) Prior Publication Data

US 2018/0270601 A1 Sep. 20, 2018

(51) Int. Cl.
*H04S 7/00* (2006.01)

(52) U.S. Cl.
CPC ..... *H04S 7/303* (2013.01); *H04S 2400/11* (2013.01)

(58) Field of Classification Search
None
See application file for complete search history.

(56) References Cited

U.S. PATENT DOCUMENTS 5,633,993 A * 5/1997 Redmann ..... G06F 3/011 345/419
9,807,502 B1 * 10/2017 Hatab ..... H04R 3/04
2009/0240359 A1 * 9/2009 Hyndman ..... H04L 65/4015 700/94
2009/0262946 A1 10/2009 Dunko
2012/0076305 A1 * 3/2012 Virolainen ..... H04M 3/568 381/17
2014/0079225 A1 * 3/2014 Jarske ..... H04R 29/00 381/56
2014/0314256 A1 10/2014 Fincham et al.
2014/0328505 A1 11/2014 Heinemann et al.
2015/0146874 A1 5/2015 Ojanpera
2015/0304758 A1 10/2015 Sorensen
2016/0154577 A1 6/2016 Lehtiniemi et al.
2016/0267759 A1 * 9/2016 Kerzner ..... G08B 13/19645
2017/0040028 A1 2/2017 Seligmann et al.

FOREIGN PATENT DOCUMENTS

EP 2741523 A1 6/2014
EP 3046341 A1 7/2016

OTHER PUBLICATIONS

Frutos-Bonilla, Javier; Gatzsche, Gabriel; Rodigast, Rene "*Latest Improvements for Spatial Sound Reinforcement: Configuration's Automation, Remote Control Using Mobile Devices, and Object Based Room Simulation*" Fraunhofer Institute for Digital Media Technology IDMT, Ilmenau, Germany; p. No. 9087 dated Apr. 25, 2014. http://www.aes.org/e-lib/browse.cfm?elib=17233.

* cited by examiner

*Primary Examiner* — Curtis A Kuntz
*Assistant Examiner* — Kenny H Truong
(74) *Attorney, Agent, or Firm* — Harrington & Smith

(57) ABSTRACT

A method including, determining, for each of at least two listening positions, a default rendering, determining an overlap for at least one audio source for the default rendering based on the at least two listening positions, determining at least one audio source rendering modification associated with at least one of the at least two listening positions based on the determined overlap, and providing a modified rendering for at least one of the at least two listening positions by processing the at least one audio source rendering so as to improve audibility of the at least one audio source during the audio rendering for at least one of the at least two listening positions.

20 Claims, 8 Drawing Sheets

PREFERENTIAL RENDERING OF MULTI-USER FREE-VIEWPOINT AUDIO FOR IMPROVED COVERAGE OF INTEREST

BACKGROUND

Technical Field

The exemplary and non-limiting embodiments relate generally to augmented-reality (AR), virtual-reality (VR), and presence-captured (PC) experiences, content consumption, and monitoring. More particularly, the exemplary and non-limiting embodiments relate to free-viewpoint rendering of spatial audio, such as object-based audio.

Brief Description of Prior Developments

Virtual reality is a rendered version of a visual and audio scene that is delivered to the user. This rendering may be designed to mimic the visual and audio sensory stimuli of the real world as naturally as possible in order to provide the user a feeling of being in a real location or being a part of a scene. Free-viewpoint in audiovisual consumption may refer to the user being able to move in this "content consumption space". Thus, the user may, for example, move continuously or in discrete steps in an area around the point corresponding to a capture point (such as the position of a virtual reality device, for example, a Nokia OZO™ device) or, for example, between at least two such capture points. The user may perceive the audiovisual scene in a natural way at each location, in each direction, in the allowed area of movement. When at least some part of the experience is simulated, for example, by means of computer-generated additional effects or modifications of the captured audiovisual information, the experience may be referred to using an umbrella term "mediated reality experience".

SUMMARY

The following summary is merely intended to be exemplary. The summary is not intended to limit the scope of the claims.

In accordance with one aspect, an example method comprises, determining, for each of at least two listening positions, a default rendering, determining an overlap for at least one audio source for the default rendering based on the at least two listening positions, determining at least one audio source rendering modification associated with at least one of the at least two listening positions based on the determined overlap, and providing a modified rendering for at least one of the at least two listening positions by processing the at least one audio source rendering so as to improve audibility of the at least one audio source during the audio rendering for at least one of the at least two listening positions.

In accordance with another aspect, an example apparatus comprises at least one processor; and at least one non-transitory memory including computer program code, the at least one memory and the computer program code configured to, with the at least one processor, cause the apparatus to: determine, for each of at least two listening positions, a default rendering, determine an overlap for at least one audio source for the default rendering based on the at least two listening positions, determine at least one audio source rendering modification associated with at least one of the at least two listening positions based on the determined overlap, and provide a modified rendering for at least one of the at least two listening positions by processing the at least one audio source rendering so as to improve audibility of the at least one audio source during the audio rendering for at least one of the at least two listening positions.

In accordance with another aspect, an example apparatus comprises a non-transitory program storage device readable by a machine, tangibly embodying a program of instructions executable by the machine for performing operations, the operations comprising: determining, for each of at least two listening positions, a default rendering, determining an overlap for at least one audio source for the default rendering based on the at least two listening positions, determining at least one audio source rendering modification associated with at least one of the at least two listening positions based on the determined overlap, and providing a modified rendering for at least one of the at least two listening positions by processing the at least one audio source rendering so as to improve audibility of the at least one audio source during the audio rendering for at least one of the at least two listening positions.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
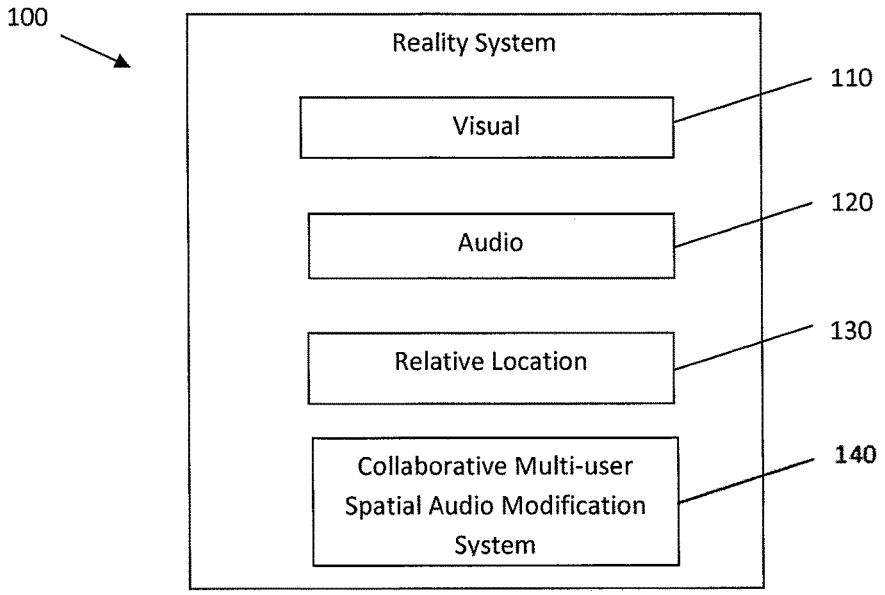
FIG. 1 is a diagram illustrating a reality system comprising features of an example embodiment.

Referring to FIG. 1, a diagram is shown illustrating a reality system 100 incorporating features of an example embodiment. The reality system 100 may be used by a user for augmented-reality (AR), virtual-reality (VR), or presence-captured (PC) experiences and content consumption, for example, which incorporate free-viewpoint audio. Although the features will be described with reference to the example embodiments shown in the drawings, it should be understood that features can be embodied in many alternate forms of embodiments.

The system 100 generally comprises a visual system 110, an audio system 120, a relative location system 130 and a collaborative multi-user spatial audio modification system 140 to improve the coverage of interest (detection, localization and separation of audio events of interest) of a competitive free-viewpoint audio rendering. The visual system 110 is configured to provide visual images to a user. For example, the visual system 12 may comprise a virtual reality (VR) headset, goggles or glasses. The audio system 120 is configured to provide audio sound to the user, such as by one or more speakers, a VR headset, or ear buds for example.

The relative location system 130 is configured to sense a location of the user, such as the user's head for example, and determine the location of the user in the realm of the reality content consumption space. The movement in the reality content consumption space may be based on actual user movement, user-controlled movement, and/or some other externally-controlled movement or pre-determined movement, or any combination of these. The user is able to move in the content consumption space of the free-viewpoint. The relative location system 130 may be able to change what the user sees and hears based upon the user's movement in the real-world; that real-world movement changing what the user sees and hears in the free-viewpoint rendering.

The user (or users) may be virtually located in the free-viewpoint content space, or in other words, receive a rendering corresponding to a location in the free-viewpoint rendering. Audio objects may be rendered to the user at this user location. User movement may affect the user interaction with audio objects. The area around a selected listening point may be defined based on user input, based on use case or content specific settings, and/or based on particular implementations of the audio rendering. The area, for example a listening area or active rendering area, may relate to the rendering of the audio objects, or the audio objects/object distances that may be considered for the rendering. Additionally, the area may in some embodiments be defined at least partly based on an indirect user or system setting such as the overall output level of the system (for example, some sounds may not be heard when the sound pressure level at the output is reduced). In such instances the output level input to an application may result in particular sounds being not decoded because the sound level associated with these audio objects may be considered imperceptible from the listening point. In other instances, distant sounds with higher output levels (such as, for example, an explosion or similar loud event) may be exempted from the requirement (in other words, these sounds may be decoded). A process such as dynamic range control may also affect the rendering, and therefore the area, if the audio output level is considered in the area definition.

Content may be captured (thus corresponding to perceived reality), computer-generated, or combination of the two. Content may be pre-recorded or pre-generated, or live footage. Live footage may be captured using a multi-microphone setup and may be processed, for example, by source-separation processes that may create audio objects corresponding to physical audio sources. The captured content and data may include, for example, spatial audio and video, point clouds, and geolocation data which may be obtained, for example, by means of radio-frequency (RF) tracking. The geolocation data may be based, for example, on HAIP (high-accuracy indoor positioning) technology. The content may include audio, such as in form of audio objects, which may be captured or generated.

Free-viewpoint audio may be determined based on the locations of sound sources and the location and rotation of the listening position. In this context, the location of the listener may be determined relative to the locations of the sound sources. The sound source locations may be available, for example, by means of object-based audio. The user rotation (roll, pitch, yaw) may be obtained via headtracking. Translational movement (for example, the movement in 3D space along x, y, z) may be based on actual user movement that may be tracked, for example, using a systems such as Kinect, or may be obtained through a user interface (UI) control. The user may listen to the free-viewpoint audio, for example, by wearing headphones that utilize headtracking and that are connected to a spatial audio rendering system. Additionally, the user may wear a head-mounted display (HMD) to view the visual content.

Exemplary embodiments may relate to free-viewpoint rendering of spatial audio, such as object-based audio, in a multi-user context. Furthermore, the exemplary embodiments may relate to multi-user interactions and interfaces for collaborative free-viewpoint consumption.

In some instances, for free-viewpoint audio, implementations of a free-viewpoint rendering that include translational movement on a plane may provide sufficient detail without requiring movement in a full 3D space. In other words, it may be sufficient to allow, for example, for horizontal only movement. Further, while main audio is expected to be diegetic (rendering corresponding to head-tracking), some audio may be non-diegetic. For example, a narrator voice position may be maintained at a constant location (with respect to the user, etc.) within the free-viewpoint rendering in some applications regardless of user movement or head rotation.

Multi-user spatial audio rendering occur in instances in which at least two users listen to a spatial audio content that is at least significantly the same. The users may be physically in the same space, for example, a VR listening room, or they may in different physical locations. In some implementations, based on particular applications and device capabilities, at least some of the users may be able to communicate to one another. For example, the headphones may allow for room sounds, or some of them such as speech, to be heard. Alternatively, there may be a communication channel, for example, utilizing a communications profile of the audio coding system or a separate communications codec.

Figure 2:
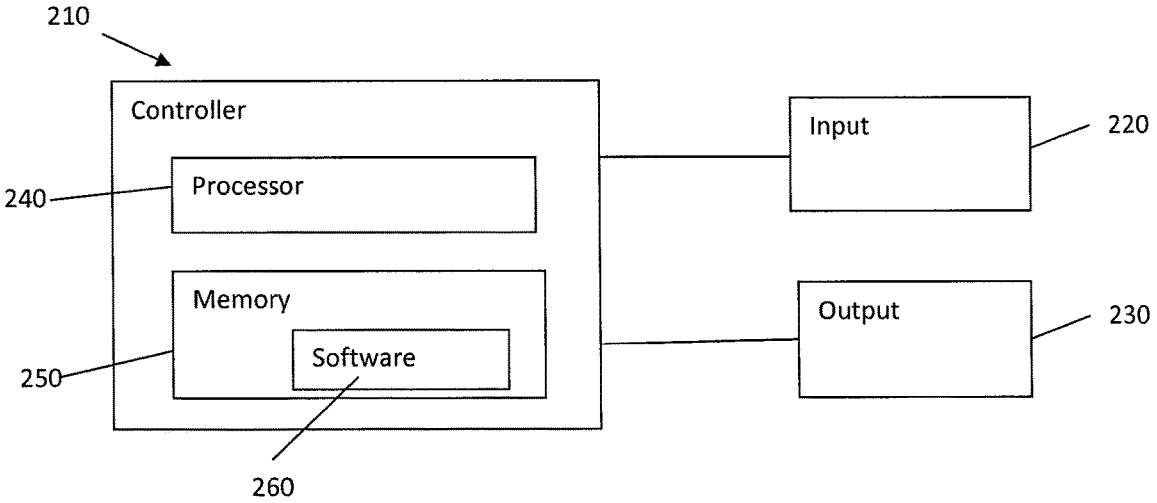
FIG. 2 is a diagram illustrating some components of the system shown in FIG. 1.

Referring also to FIG. 2, the reality system 100 generally comprises one or more controllers 210, one or more inputs 220 and one or more outputs 230. The input(s) 220 may comprise, for example, location sensors of the relative location system 130 and the collaborative multi-user spatial audio modification system 140, rendering information to improve the coverage of interest of a competitive free-viewpoint audio rendering from the collaborative multi-user spatial audio modification system 140, reality information from another device, such as over the Internet for example, or any other suitable device for inputting information into the system 100. The output(s) 230 may comprise, for example, a display on a VR headset of the visual system 110, speakers of the audio system 120, and a communications output to communication information to another device. The controller(s) 210 may comprise one or more processors 240 and one or more memory 250 having software 260 (or machine-readable instructions).

Figure 3A:
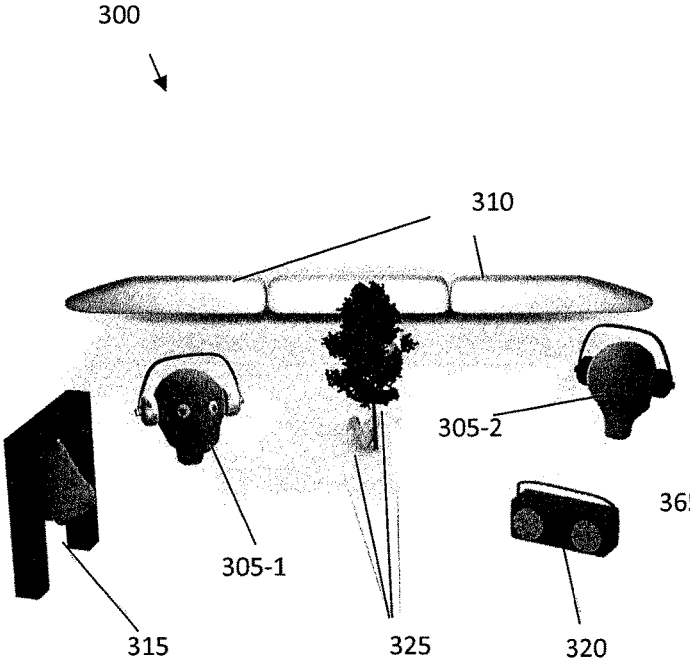
FIGS. 3*a* and 3*b* are example illustrations of a multi-user free-viewpoint audio use case and a system that may implement the multi-user free-viewpoint audio.
Figure 3B:
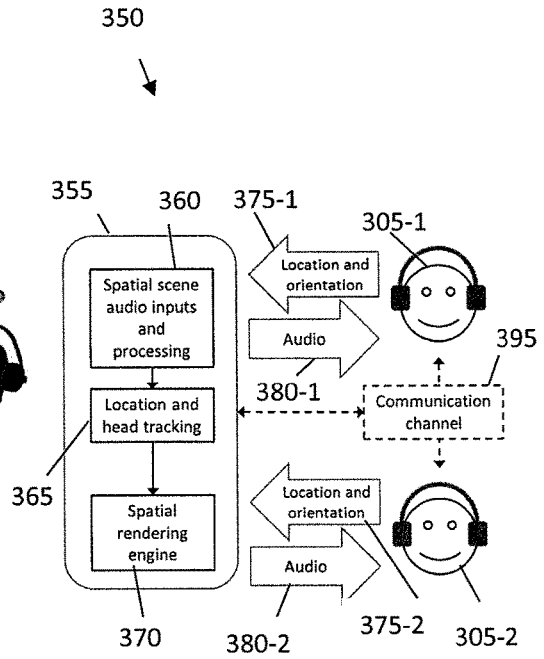

Referring also to FIGS. 3*a* and 3*b*, illustrations of a multi-user free-viewpoint audio use case 300 and an associated system 350 are shown. The free-viewpoint audio scene may consist of various audio objects with very different characteristics (illustrated, for example, as a wide dynamic object 310, a mostly silent object 315, a stereo object 320, dynamic monaural objects moving in x-y-z planes 325, etc., as shown in FIG. 3*a*). Rendering at some locations may become very "rich" in audio (for example, consisting of overlapping audio from many audio objects), and it may be difficult for a user to perceive particularly important audio (for example, based on a masking effect from one or more other audio objects). In addition, the listening position (for example, the user or virtual position in the audio scene) may hear communications rendering, for example, from the at least second participant (for example, a second listening position (for example, the second user 305-2 or virtual position in the audio scene) may comprise an additional audio object for the first user 305-1, or the captured voice of the second user 305-2 may comprise non-diegetic audio for the first user 305-1). In some instances, for example an augmented reality scenario, the listening positions may correspond to different devices, such as, for example, a drone, which may provide the second listening position.

System 350 may include a reality system 355 that includes a spatial scene audio inputs and processing component 360, a location and head tracking component 365, and a spatial rendering engine 370. The users 305-1 and 305-2 (which may correspond to virtual positions or listening positions in an audio scene) may receive audio (380-1 and 380-2, respectively) and transmit location and orientation (375-1 and 375-2, respectively) to the reality system 355. Communication between the users 305-1 and 305-2 and between each of the users and reality system 355 may occur via communication channel 395.

As shown in FIG. 3*b*, two users (shown in FIG. 3, as user 1 (305-1) and user 2 (305-2)), prior to implementation of an exemplary embodiment, may communicate (via communication channel 395) about their experience/rendering and how it corresponds to what the other user is being rendered. In other words, the at least two users (for example, users 305-1 and 305-2, although there may be more than two users in the collaborative multi-user rendering, two users 305-1 and 305-2 are shown in FIGS. 3*a* and 3*b* by way of illustration) may ask each other what they are hearing, or whether and why they are listening to something specific in the free-viewpoint audio 380 (shown as 380-1 and 380-2 corresponding to the two users 305-1 and 305-2, respectively). If the VR/AR application has a visual indicator, such as an avatar (now shown in FIGS. 3*a* and 3*b*), to indicate the whereabouts of at least one other user, a user wearing HMD may also look around and see the location of the other user(s). In instances in which no display is used, they will lack this opportunity.

However, in these instances, problems may arise for monitoring and experiencing the content. For example, if the two users (305-1 and 305-2) directly communicate with each other (or look around for each other in instances in which visual content is also available), the users may become distracted from the content that they are monitoring or otherwise experiencing, and may also mask audio events for themselves as well as the other user by inserting the communication audio. To avoid masking from communications between users, users may stop communicating with each other. However, without implementation of an exemplary embodiment, this approach removes the direct possibility of getting feedback on what the other user hears and/or does not hear.

Figure 4:
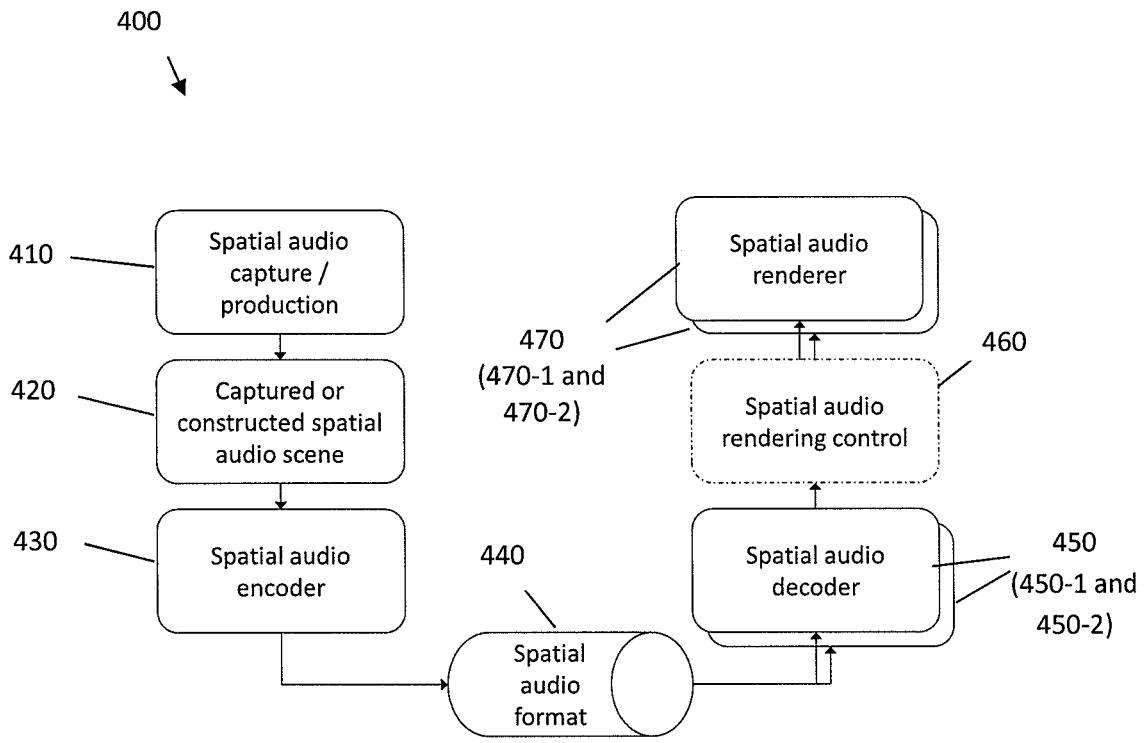
FIG. 4 is a diagram illustrating audio system components for a free-viewpoint audio service.

Referring also to FIG. 4, an illustration of an end-to-end system 400 for detecting a locational source rendering overlap between at least two users and adjusting for a preferential rendering of an audio object or source is shown.

An exemplary embodiment, as shown in FIG. 4, may provide direct feedback to a first user 305-1 regarding what at least a second user 305-2 hears or does not hear in multi-user free-viewpoint audio rendering. This may be achieved without communication between users, thereby avoiding any masking effects associated with inter-user communication. The system 400 may be used to implement corresponding applications, such as collaborative multi-user monitoring of a free-viewpoint audio mix or other simultaneous monitoring (for example, security monitoring), in which it would be highly beneficial for a first user 305-1 to know what at least a second user 305-2 is listening to, and/or what no other user is listening to.

System 400 may provide information regarding sound experienced (for example, received/not received) by the other user in instances of a collaborative multi-user rendering. Collaborative multi-user rendering may occur in instances in which at least two users (for example, users 305-1 and 305-2) are not only experiencing at least significantly the same free-viewpoint content, but also aim to observe as much of the content as possible when combining their individual percept (for example, a combined or group percept).

Collaborative multi-user listening/rendering, may be applied in instances of competitive rendering and collaborative rendering. Collaborative rendering refers to instances in which the system 400 determines individual audio renderings for the two users to collectively hear as much of the same content as suitable, although they may not by default be rendered any same audio. Competitive rendering refers to instances in which the system 400 determines individual audio renderings for the at least two users to hear as much as possible (group percept), where the default renderings for the at least two users share at least some of the same audio. A default rendering for a user includes a scene that the user would receive without any modification. In some example embodiments, the default rendering include the effects of viewing angle (for example, head rotation) and a user location.

The collaborative multi-user rendering extends the scope of how and what is rendered to listeners (the at least two users 305-1 and 305-2) by the system. An exemplary embodiment may provide feedback information that may allow the at least two listeners to cover as large part of the audio scene in terms of localization and separation of the audio events as they might optimally cover. An exemplary embodiment may allow the users in a collaborative multi-user rendering (such as users 305-1 and 305-2) to alleviate various masking effects related to the scene and, particularly, the human hearing.

As shown in FIG. 4, the system 400 may include free-viewpoint audio system components, which may process audio received within the collaborative multi-user rendering for one or more of the users, such as a spatial audio capture/production component 410 (that may produce and/or capture spatial audio), a captured or constructed spatial audio scene 420, which may be an output from spatial audio capture/production component 410, a spatial audio encoder 430 (that may encode spatial audio), and a spatial audio format 440. Spatial audio format 440 may be used to store or transmit the spatial audio and it may include separate formats for production, storage, and distribution. The received spatial audio format 440 may be relayed for decoding using a spatial audio decoder 450 (450-1 and 450-2) for each of the users. A spatial audio rendering control 460 may be applied to the decoded audio output of the spatial audio decoder 450. Spatial audio rendering control 460 may denote a separate service for controlling the individual spatial audio renderers. Spatial audio renderer 470 (470-1 and 470-2) (or a service that supports multi-user free-viewpoint listening) for each of the users may render the audio corresponding to the particular user (for example, user 305-1 and user 305-2).

The system 400, as shown in FIG. 4, may provide feedback information without requiring a communication channel (communication channel such as shown in FIG. 3*b*), which may provide another masking effect of its own and overall distract each of the users 305-1 and 305-2 from a primary audio focus/task. The system 400 may improve the performance by applying a spatial audio modification that is based on the explicit feedback on what at least a second user 305-2 is listening to, and implicitly also what the other user 305-2 is not listening to. The system 400 may provide a collaborative multi-user spatial audio modification to improve the coverage of interest (detection, localization and separation of audio events of interest) of a competitive free-viewpoint audio rendering. An exemplary embodiment may provide audio feedback or modification for free-viewpoint multi-user audio interaction, where the rendering of scene-based, multichannel, and/or audio-object based audio is enhanced for a first user 305-1 based on the rendering for at least a second user 305-2 in order to extend the coverage of interest (detection, localization and separation of audio events) by the at least two collaborative users.

An exemplary embodiment may provide features that may be used for "coverage extension of interest" in a competitive rendering mode (or in a collaborative rendering mode). In the competitive rendering mode, audio objects that fall under a locational source rendering overlap between at least two users are considered in an "automatic adaptive differential audio focus" (or preferential rendering), which adapts the rendering of each user based on what the other user(s) is (are) being rendered. A locational source rendering overlap (or locational rendering overlap) may occur for renderings associated with at least two users where there is an overlap between the default renderings for an audio source in a collaborative multi-user rendering of free-viewpoint audio. The balancing of audio object rendering in a commonly rendered area between at least two users may result in an improved overall/combined perception of the spatial audio scene. In other words, the total number of audio objects being rendered for the at least two users combined may be kept constant when applying the modification. However, the rendering of the audio objects may be balanced between the at least two users (for example, users 305-1 and 305-2) such that they are more likely to perceive more overall/together, and masking audio objects may be removed or reduced in level for at least one user 305-1 while amplifying other objects (and vice versa for the at least second user 305-2). The amplification of some audio objects and reduction of other audio objects provides a modified balance for at least two users and may thereby apply a spatial coverage extension of interest.

According to an embodiment, an exemplary embodiment may perform a different modification to the audio rendering for the at least two users based on whether the rendering is a collaborative rendering, or a competitive rendering. In instances of a collaborative rendering, an exemplary embodiment of the collaborative rendering mode may amplify, for at least one user, a sound source that is rendered for the at least two users where the loudest rendering is used as a reference level for the amplification.

An exemplary embodiment may provide a competitive free-viewpoint audio rendering in which at least two users (for example, users 305-1 and 305-2) are collaboratively listening to at least significantly the same free-viewpoint audio environment and the at least two users (for example, users 305-1 and 305-2) are being rendered, due to their current locations, at least one common audio object or source. The users 305-1 and 305-2 may attempt to cover as large a part of the complete audio scene as possible. In other words, the at least two users 305-1 and 305-2 may attempt to detect and localize as many audio events of interest in the said scene as possible. However, the rendering for each user is primarily determined by their current rendering location in the spatial audio scene, and therefore the detection, localization and separation of the audio events of interest may be aided by spatial audio modification. In other words, while each user's individual rendering corresponds to their current location, the audio balance regarding at least one audio object or source may be modified between the at least two users.

When determining the audio rendering for the at least two users 305-1 and 305-2, the default individual rendering may correspond to the spatial rendering each user would normally receive. Sound sources, such as audio objects, may be categorized on the basis of whether the sound sources contribute to any of the default renderings. Those sound sources that contribute to at least one rendering may be modified in some exemplary embodiments, and those sound sources that contribute to at least two renderings may be further modified in an exemplary embodiment. The modification may be determined based on the relative rendering of the sound sources for each user as well as the complete rendering of each user. This preferential rendering may be determined based on at least the default individual rendering of the at least two users 305-1 and 305-2, all sound sources heard simultaneously by the at least two users 305-1 and 305-2, and the relative rendering of the respective sound sources for the at least two users 305-1 and 305-2.

An exemplary embodiment may perform modification of the audio rendering based on audio sources which none of the at least two users hear at their current locations, for example using a system such as described in U.S. patent application Ser. No. 15/412,561, filed Jan. 23, 2017, which is hereby incorporated by reference.

The system 400 may consider at least the default individual rendering of the at least two users, all sound sources heard simultaneously by the at least two users, and the relative rendering of the respective sound sources for the at least two users.

An exemplary embodiment may be implemented in the context of a hardware product, such as a Blu-ray player, supporting free-viewpoint audio. In this case, the minimum requirement for the system is to provide at least two individual audio output streams, which may be available, for example, via headphone outputs or a wireless radio connection. The hardware product may either run a free-viewpoint spatial renderer itself or receive control input from a separate device or service. Devices that are connected to each other via a service may also be used each providing the rendering for at least one user.

Alternatively to a service that supports multi-user free-viewpoint listening, an exemplary embodiment may be implemented in at least two instances of a single-user spatial renderer that accepts audio-object modification commands, for example, from a service. Some aspects of an exemplary embodiment, such as audio object properties to control how an audio object may be modified for presentation to at least a second user, may also be implemented in an audio object encoder and a related format.

Figure 5:
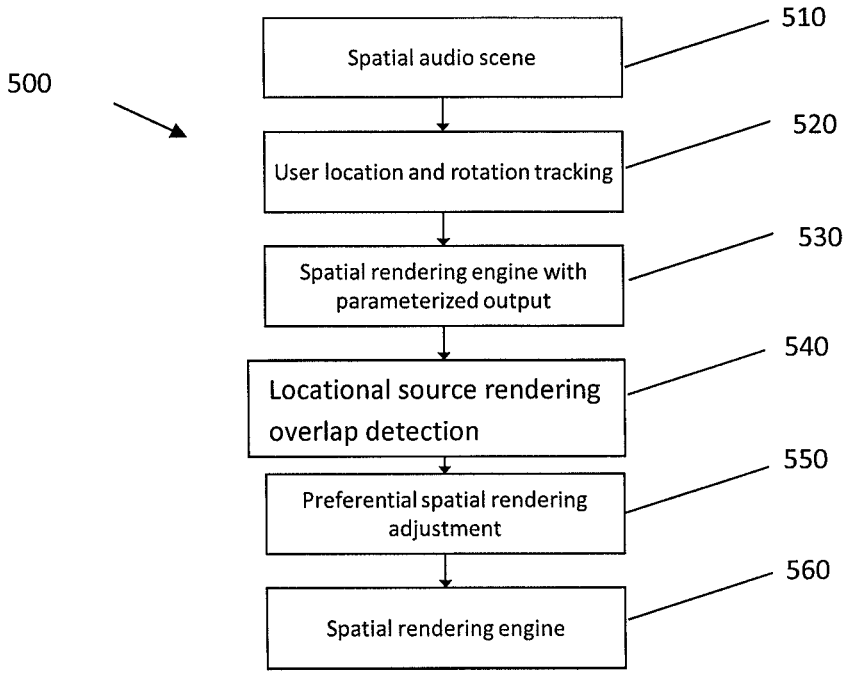
FIG. 5 illustrates a system for detecting a locational source rendering overlap and applying a preferential spatial rendering adjustment.

Referring also to FIG. 5, a system 500 for detecting a locational source rendering overlap and applying a preferential spatial rendering adjustment is shown. Each component of system 500 may correspond to a system step in a corresponding process. An exemplary embodiment may be implemented based on particular system steps to implement the process of detecting a locational source rendering overlap and applying a preferential spatial rendering adjustment. Although a particular order is shown for brevity, it should be understood that the system steps may include fewer or additional steps in a different order and that steps may be repeated.

As shown in FIG. 5, the system 500 may include a spatial audio scene component 510 (that may perform a spatial audio scene step), a user location and rotation tracking component 520 (that may perform a user location and rotation tracking step), a spatial rendering engine with parametrized output 530 (that may perform a step of spatial rendering and parametrization), a locational source rendering overlap detection component 540 (that may perform a step of locational source rendering overlap detection), a preferential spatial rendering adjustment component 550 (that may perform a step of preferential spatial rendering adjustment), and a spatial rendering engine 560.

The system 500 may introduce a modification of the spatial rendering engine (by spatial rendering engine with parametrized output 530), in which a first output of the spatial rendering engine may consist of a parameterization of each spatial audio source for each current user. Based on this information, existence of a locational source rendering overlap for each audio source may be evaluated between the two users/renderings (for example, by locational source rendering overlap detection component 540). In instances in which the locational source rendering overlap for each audio source is detected between the two users/renderings, an exemplary embodiment may determine which of the users (or both) should hear which common audio source and at what relative level. For each locational source rendering overlap detected for at least one spatial audio source, the system 500 may also determine at what relative level each of the users (or both) should hear the common audio source.

The system 500 may apply a preferential spatial rendering adjustment (for example, via preferential spatial rendering adjustment component 550), which may be implemented to score a balance between the two users by preferring the rendering of each common spatial audio source for one user over the other. This information may be fed again to the spatial rendering engine 560, which may produce the output with improved coverage of interest for the at least two collaborative users.

Figure 6:
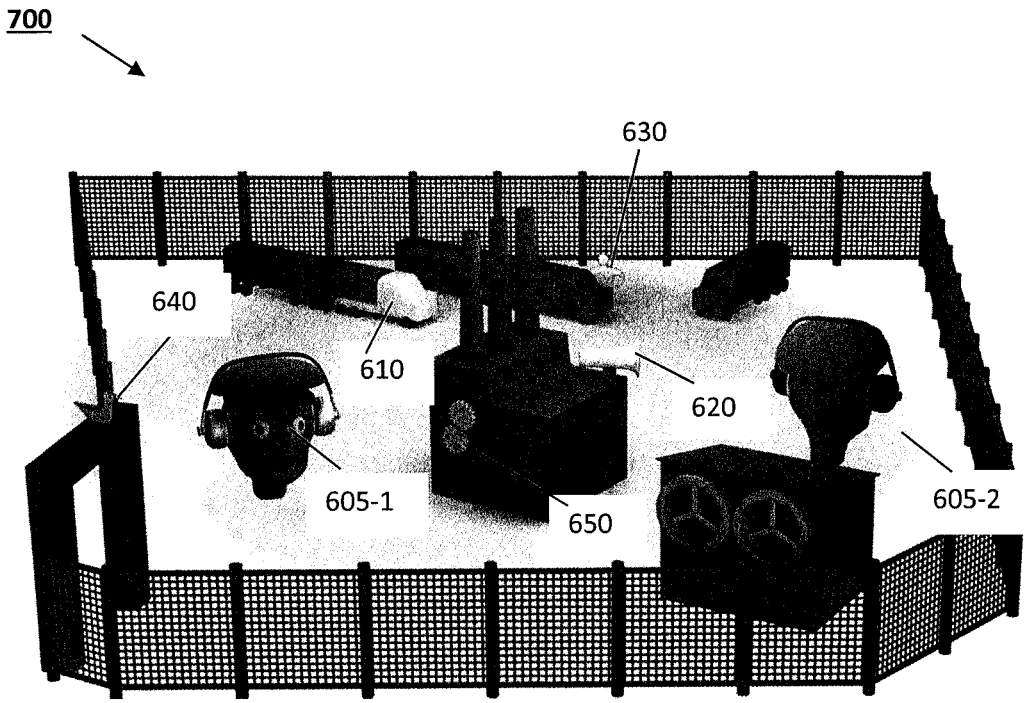
FIG. 6 illustrates an example embodiment of a multi-user free-viewpoint audio use case.

Referring also to FIG. 6, a multi-user free-viewpoint audio use case implementation of an exemplary embodiment of the system for security monitoring is shown. Multi-user free-viewpoint audio use case 600 may include sound sources mapped as audio objects by the capture system as shown in FIG. 6.

Multi-user free-viewpoint audio use case 600 may include two users, 605-1 and 605-2, who work as security guards. The two users may have the assigned responsibility of monitoring the security and systems of a site (for example, an industrial site). The surveillance may be based on a sensor system including at least cameras and microphones. Based on the audiovisual inputs, the guards may patrol the site virtually utilizing at least a free-viewpoint audio rendering. The Multi-user free-viewpoint audio use case 600 may allow the users to virtually monitor the site and to remain within a monitoring control area until presence is required at the site based on the monitoring (for example, if something abnormal is detected).

According to an embodiment, FIG. 6 illustrates the two security guards in virtual patrol. Similarly to FIGS. 3*a* and 3*b*, these two users may hear audio objects around them based on their direction and volume. The two users may hear some audio objects simultaneously. While this may provide a natural user experience for the two users, this richer audio environment (for example, a larger amount of separate simultaneous audio) may make it more difficult for each user to find those audio events that are of particular interest. The environment may include audio sources or audio objects 610-650 (for example, a truck engine 610, a horn 620, an intruder 630, a bird 640 and factory mechanisms 650), which may all contribute in different relative levels to each of the users 605-1 and 605-2, based on an unadjusted free-viewpoint audio rendering.

An exemplary embodiment may provide an audio modification that takes the common coverage of audio events into account. This modification may be carried out according to an exemplary embodiment to significantly reduce the overlap between what the two users hear and thereby improve the ability of at least one of the users to hear and distinguish audio events that would otherwise be masked. The modification may allow one of the users (for example, security guards) to detect an intruder at the site (for example, a truck depot of the industrial site) that would otherwise remain undetected due to masking effects (for example, from audio sources that may be positioned closer to the other user).

According to an exemplary embodiment, the rendering system may observe in the above situation a competitive audio rendering in which at least two users are listening to the same free-viewpoint audio environment while attempting to cover as large a part of the complete audio as possible with the highest possible degree of localization and detectability of events of interest. In other words, while each user's individual rendering must correspond to their current location, the balance regarding at least one audio object or source may be modified such that the goal of covering as large a part of the complete audio as possible with the highest possible degree of localization and detectability of events of interest may be reached.

The system 500 may improve the listening experience and users' performance for a task in a collaborative multi-user rendering of free-viewpoint audio. When at least two users are collaboratively listening to a multi-user free-viewpoint audio rendering, the at least users may be rendered a large number of audio sources (for example, as illustrated in FIG. 6). The users may become overwhelmed by the number of audio sources, for example N1 and N2, etc., (for example, truck engine 610, horn 620, intruder 630, etc., as shown in FIG. 6) for two users U1 and U2 (for example, users 605-1 and 605-2, as shown in FIG. 6), respectively, and therefore be unable to concentrate on particular changes in the audio scene. On the other hand, sound sources in the same general direction relative to a user and/or the same frequency band may also mask each other. This may result in the users missing key audio events of interest, or to otherwise not perform well in their task.

The system 500 may identify those sources M that at least two users would be rendered by default. In other words, both $N_1$ and $N_2$ for users $U_1$ and $U_2$ includes sources M. The system 500 may determine an adjusted balance between the renderings of the at least two users for each common source M. By balancing (for example, muting, attenuating or amplifying, in some embodiments also spatially moving), at least one source between the at least two users, at least one of the users will have a better chance of hearing the said source (that has now been amplified) or another source (that would, for example, have otherwise been masked by the source that was attenuated/muted). The combined performance of the at least two users in performing their task may thus be improved.

Figure 7:
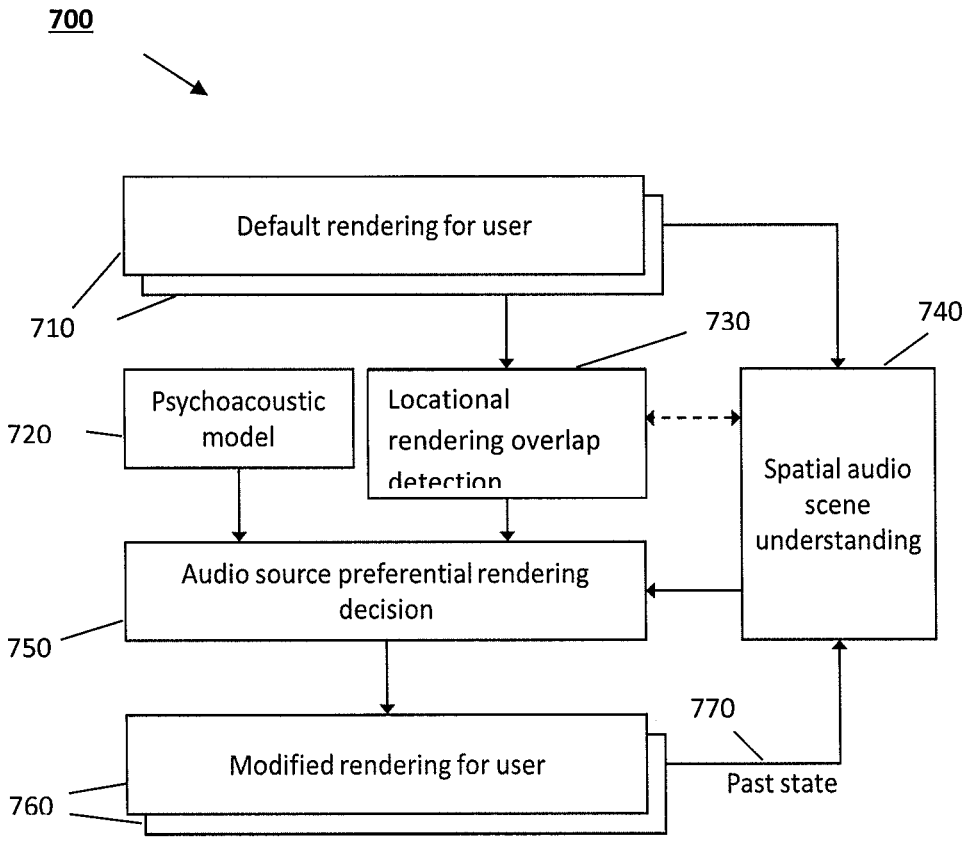
FIG. 7 illustrates system steps for locational source rendering overlap detection and preferential spatial rendering adjustment of FIG. 5.

Referring also to FIG. 7, an illustration of a system 700 that includes components for implementing locational source rendering overlap detection component 540 and preferential spatial rendering adjustment 550 of system 500 (see description of FIG. 5 above) is shown.

As shown, system 700 includes a default rendering component 710 for each of at least two users, a psychoacoustic model 720, a locational source rendering overlap detection component 730 which receives the output of the default rendering components 710, a spatial audio scene understanding component 740, an audio source preferential rendering decision component 750 (that may determine which (or both) of the users each audio source is to be associated with and at what particular levels), which may use the psychoacoustic model 720, the output of the locational source rendering overlap detection component 730, and the output of spatial audio scene understanding component 740 to determine a modified rendering 760 for each user. Spatial audio scene understanding may include determining whether at least two audio sources are related, whether any audio sources should not be modified (for example, in terms of volume, location, etc.), how analysis of user movement paths should effect calculations of audio modifications in the renderings, etc. Spatial audio scene understanding component 740 may also receive the default rendering 710 for each of at least two users, the detected locational source rendering overlap 730 and the modified rendering 760 for each user indicating past states 770 associated with the users.

The system 700 may generate at least two instances of default rendering 710 and modified rendering 760 based on the at least two users.

Referring back to FIG. 5, the preferential spatial rendering adjustment component 550 may determine the preferential spatial rendering adjustment for each user by considering each audio source at a time. For example, the preferential spatial rendering adjustment component 550 may first consider the most dominant common audio for the at least two users and then proceed to the next most dominant common audio through each of the audio sources. However, analysis of the overall spatial audio scene, such as shown in FIG. 7, (via spatial audio scene understanding component 740) may allow preferential spatial rendering adjustment component 550 to, for example, determine if certain audio sources are directly related. This analysis may be based, for example, on metadata received by the system 500.

In instances in which particular audio sources are related, the audio sources may be analyzed (and, in some instances, processed) jointly. In addition, spatial audio scene understanding component 740 may consider (for example, utilize information regarding past states or past modifications) in order to smooth out any abrupt changes. Changes may otherwise be disturbing for the user especially if a particular modification is repeatedly carried out back and forth. In addition to the audio scene understanding determined by spatial audio scene understanding component 740, the psychoacoustic model 720 may be used to control the overall loudness, spatial, and frequency masking effects for each user. The psychoacoustic model 720 may allow for finding the user for which audio from a particular audio source would be more effectively distributed (for example, "fit better").

In some exemplary embodiment, the psychoacoustic model 720 may, for example, predict user movement and utilize the predicted user movement as an input to determine the modified rendering for at least one of the users. In some embodiments, the location of an audio source may be modified for at least one user.

The collaborative rendering may be implemented, for example, in instances where at least two people are together working remotely on a problem such as, for example, faulty machinery, multi-disciplinary issues, etc. Further example embodiments may be implemented in teaching (or instructing) scenarios in which at least one student (or person) follows what a teacher (or instructor) is demonstrating and discussing.

The system 700 may provide for a modification of spatial audio rendering for multi-user collaborative free-viewpoint audio use cases. An exemplary embodiment of the system 700 may improve the coverage of spatial percept of audio objects in a multi-user collaborative rendering, where audio objects may otherwise be, for example, masked by other audio objects thus becoming inaudible to the users. The system 700 may allow for enhancement of the audio rendering in a manner that at least one user may perceive and monitor an audio object in a manner that approximates a direct rendering of the audio object (for example, a natural rendering of the audio object within the environment) without compromising the overall spatial rendering. An example embodiment may be implemented in monitoring applications that may relate to use cases such as security as well as spatial audio mixing. An example embodiment may also allow, for example, for collaborative users to each focus on a particular instrument, portion or direction of the spatial audio when mixing it, and for collaborative users to detect as many audio events as possible in a security or monitoring use case.

According to an example embodiment, the security guards may actually walk the area equipped with headphones and a user interface where they may select a virtual position. Each guard may, for example, switch between receiving the actual (or augmented) audio at his own real position or the virtual audio at the virtual position. When there are at least two guards, their real and virtual areas may overlap in various ways. The third options is a combination. A rendering point extension, such as described in U.S. patent application Ser. No. 15/412,561, may in this instance be provided via a drone.

Figure 8:
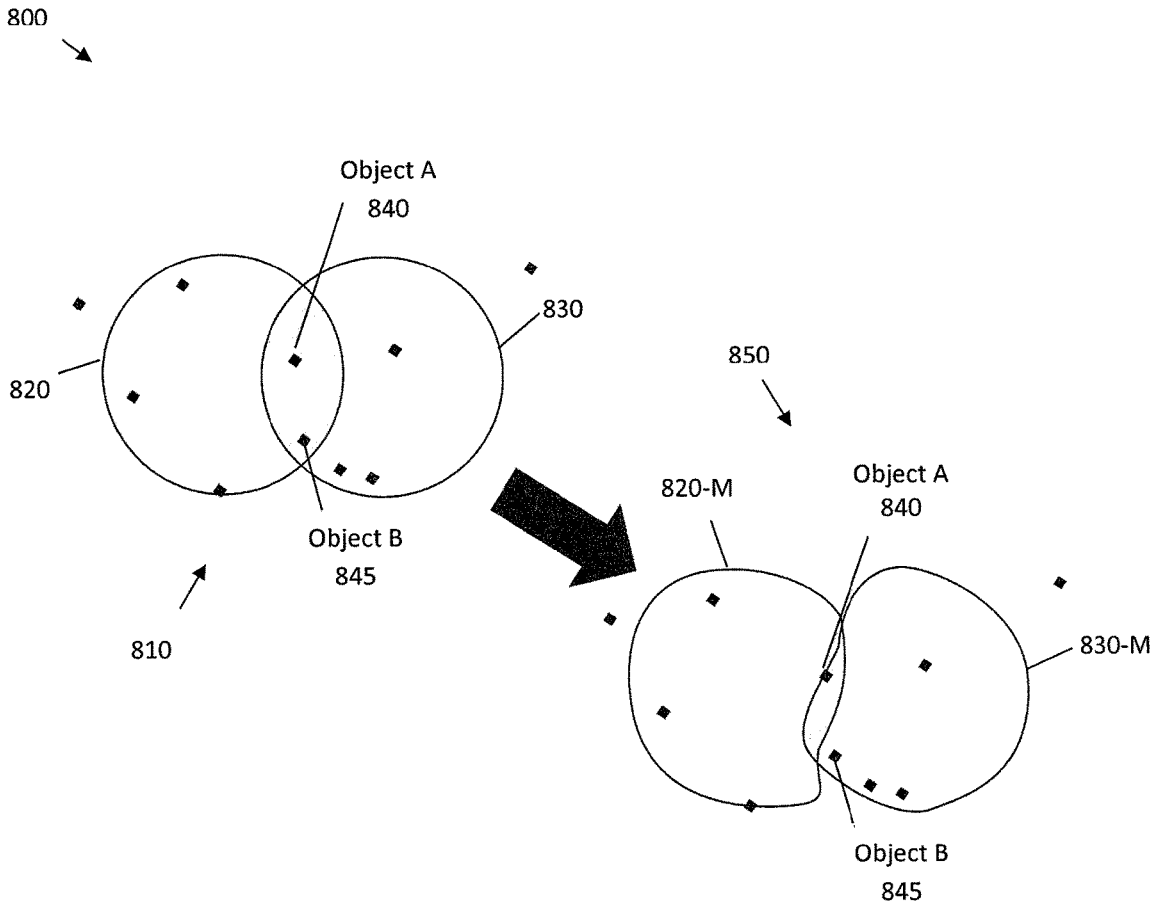
FIG. 8 is a diagram illustrating modification of rendering area shape and size at overlapping rendering range for two users.

Referring also to FIG. 8, an illustration of modification 800 of the shape of the "rendering areas" 820 and 830 for two users is shown according to the preferential rendering adjustment determined by example embodiments.

As shown in FIG. 8, rendering areas for a first and second user (820 and 830, respectively, as shown in stage 1, 810 of FIG. 8) may receive a modification of "rendering area shape and size" at overlapping rendering range for the two users to form modified rendering areas (820-M and 830-M, respectively, as shown in stage 2, 850 of FIG. 8, which occurs after modifying rendering areas shown at stage 1, 810). Audio object A 840 may remain audible for both users, but its volume may be reduced for the user associated with modified rendering area 830-M (on the right-hand side at each stage). Audio object B 845 may become inaudible for the user associated with modified rendering area 820-M (on the left-hand side), as the system may prefer the right-hand side user in that particular instance.

Figure 9:
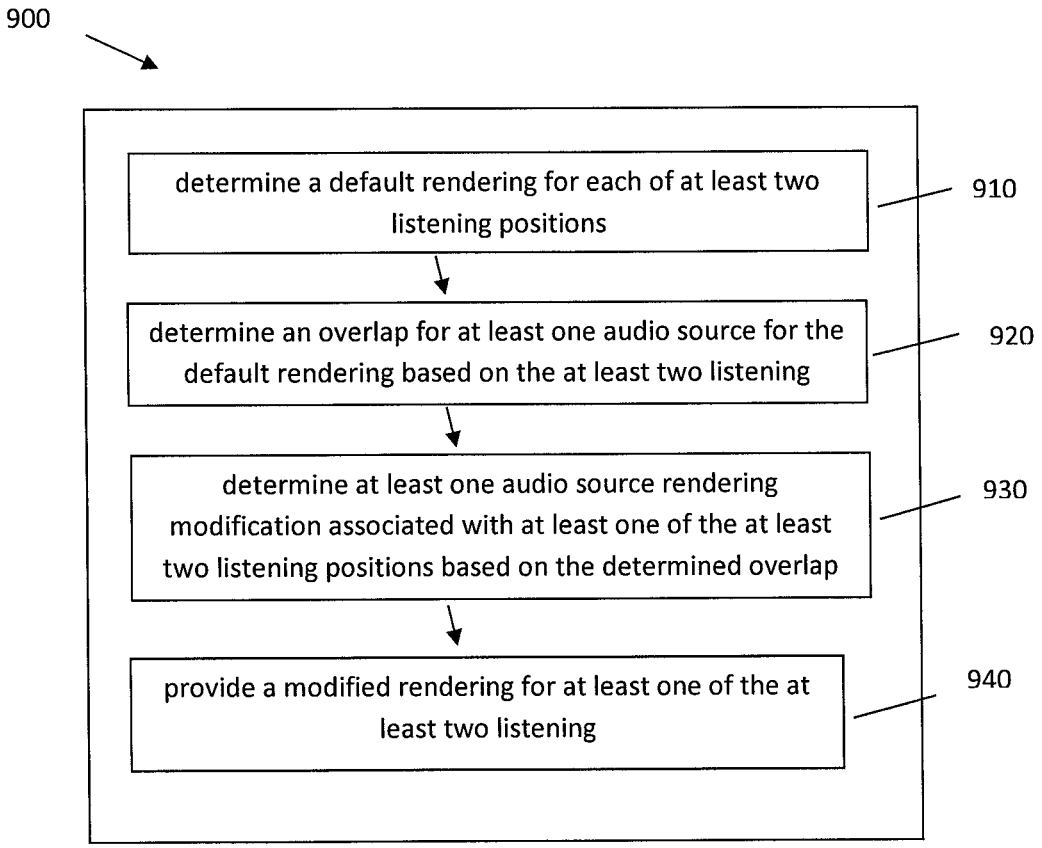
FIG. 9 is a diagram illustrating an example method.

FIG. 9 presents an example of a process of implementing preferential rendering of multi-user free-viewpoint audio for improved coverage of interest. In one implementation, process 900 may be performed by system 700. In another implementation, some or all of process 700 may be implemented by additional devices including all or portions of system 700.

At block 910, the system 700 may determine for each of at least two listening positions, a default rendering. Alternatively, the system 700 may receive a default rendering for each of at the least two listening positions in a multi-user free-viewpoint audio environment. In some instances, the at least two listening positions may be fixed positions. The scene in these instances may be dynamic based on audio source movement.

The system 700, may also perform spatial audio scene understanding on the default renderings for the two listening positions (for example, two users) based on the default renderings for the at least two listening positions.

At block 920, the system 700 may determine an overlap for at least one audio source for the default rendering based on the at least two listening positions. For example, the system 700 may perform locational source rendering overlap detection based on the default renderings (from block 910) and, in some instances, based further on the results of the spatial audio scene understanding.

At block 930, the system 700 may determine at least one audio source rendering modification associated with at least one of the at least two listening positions based on the determined overlap.

At block 940, the system 700 may provide a modified rendering for at least one of the at least two listening positions by processing the at least one audio source rendering so as to improve audibility of the at least one audio source during the audio rendering for at least one of the at least two listening positions. The modified rendering may be fed back into the spatial audio scene understanding.

The modified rendering may improve the group percept (relative to any of the at least two default renderings), for example, by making the single audio source be heard better by at least one of the at least two listening positions (for example, at least users). The modified rendering may, in some instances, be removed for the at least second listening position (for example, a second user) for whom the percept is not improved. In some instances, the renderer may select to retain portions of the modified rendering for the at least second listening position.

According to an embodiment, the system may be implemented in a free-viewpoint monitoring system, such as described in U.S. patent application Ser. No. 15/397,008, filed Jan. 3, 2017, which is hereby incorporated by reference. A user in the free-viewpoint monitoring system may, for example, based on a certain mixing target receive a multitude of audio signals (or audio objects) for rendering based on user's position in the free-viewpoint audio scene. As a single user in the free-viewpoint monitoring system may at any time only monitor a single position (although he may freely switch between positions), it may become difficult for a single user in demanding spatial audio captures to monitor a live mix. This may particularly present problems in large, complex productions (such as, for example, artist world tours, the Super Bowl, etc.).

An exemplary embodiment disclosed herein may implement the free-viewpoint monitoring system, such as described in U.S. patent application Ser. No. 15/397,008, as a multi-user system, where at least two users are monitoring and performing the mix simultaneously. One user may be designated the master mixer in such use case. In that instance, an exemplary embodiment allows for the at least two users to spread out into the spatial audio capture scene and mix collaboratively. The users may, for example, utilize a UI to switch between their personal modified rendering to concentrate on particular sounds and the overall unmodified default rendering to listen to the actual mix that is sent out to broadcast. An exemplary embodiment thus improves the coverage of interest, for example, localization and detectability of audio events of interest, for the monitoring users and allows this way for more nuanced audio experience for the end user.

In accordance with an example, a method may include determining, for each of at least two users, a default rendering, performing spatial audio scene understanding based on the default renderings, performing locational source rendering overlap detection based on the default renderings, determining at least one audio source preferential rendering decision based on the locational source rendering overlap detection and the spatial audio scene understanding, and determining a modified rendering for at least one of the at least two users based on the audio source preferential rendering decision.

In accordance with another example, an example apparatus may comprise at least one processor; and at least one non-transitory memory including computer program code, the at least one memory and the computer program code configured to, with the at least one processor, cause the apparatus to: determine, for each of at least two users, a default rendering, perform spatial audio scene understanding based on the default renderings, perform locational source rendering overlap detection based on the default renderings, determine at least one audio source preferential rendering decision based on the locational source rendering overlap detection and the spatial audio scene understanding, and determine a modified rendering for at least one of the at least two users based on the audio source preferential rendering decision.

In accordance with another example, an example apparatus may comprise a non-transitory program storage device readable by a machine, tangibly embodying a program of instructions executable by the machine for performing operations, the operations comprising: determining, for each of at least two users, a default rendering, performing spatial audio scene understanding based on the default renderings, performing locational source rendering overlap detection based on the default renderings, determining at least one audio source preferential rendering decision based on the locational source rendering overlap detection and the spatial audio scene understanding, and determining a modified rendering fox at least one of the at least two users based on the audio source preferential rendering decision.

In accordance with another example, an example apparatus comprises: means for determining, for each of at least two users, a default rendering, means for performing spatial audio scene understanding based on the default renderings, means for performing locational source rendering overlap detection based on the default renderings, means for determining at least one audio source preferential rendering decision based on locational source rendering overlap detection and spatial audio scene understanding, and means for determining a modified rendering for each of the at least two users based on the audio source preferential rendering decision.

Any combination of one or more computer readable medium(s) may be utilized as the memory. The computer readable medium may be a computer readable signal medium or a non-transitory computer readable storage medium. A non-transitory computer readable storage medium does not include propagating signals and may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. A method for an audio rendering comprising:

determining, for each of at least two listening positions, a default audio rendering, wherein the default audio rendering for each of the at least two listening positions includes an audio scene that a user would receive at the each of the at least two listening positions;

determining an overlap in the default audio renderings for the at least two listening positions, wherein the overlap includes at least one audio source that is included in at least two of the default audio renderings for the at least two listening positions;

determining at least one audio source rendering modification associated with at least one of the at least two listening positions based on the determined overlap; and providing a modified rendering for at least one user at the at least one listening position, where the providing of the modified rendering comprises processing the at least one audio source rendering modification so as to change a first emphasis at which the at least one audio source is rendered, where the first emphasis is changed relative to a second emphasis at which the at least one audio source is rendered with respect to at least one other of the at least two listening positions.

2. The method of claim 1, where determining, for each of the at least two listening positions, the default audio rendering, further comprises:

determining the default audio rendering in a free-viewpoint audio rendering.

3. The method of claim 1, where providing the modified rendering for the at least one listening position further comprises:

providing a preferential rendering based on the default audio renderings, all sound sources received simultaneously with the at least two listening positions, and a relative rendering of each of the all sound sources for the at least two listening positions.

4. The method of claim 1, wherein determining, for each of the at least two listening positions, the default audio rendering, further comprises:

determining to receive, for each of the at least two listening positions, the default audio rendering from at least one service.

5. The method of claim 1, further comprising:

determining the default audio rendering based on a security monitor system for a site.

6. The method of claim 1, where determining the at least one audio source rendering modification associated with the at least one listening position further comprises:

determining the at least one audio source rendering modification based on sound sources that contribute to at least one of the default audio renderings.

7. The method of claim 1, wherein providing the modified rendering for the at least one listening position further comprises:

providing the at least one audio source rendering modification to include an audio balance across the at least two listening positions that covers a largest portion of a complete audio scene with localization and separation of events of interest.

8. The method of claim 1, where determining the modified rendering for the at least one listening position further comprises:

determining the modified rendering for the at least one listening position to include at least one audio source not included in any of the default audio renderings for the at least two listening positions.

9. The method of claim 1, wherein determining the at least one audio source rendering modification associated with the at least one listening position further comprises:

determining the at least one audio source rendering modification based on at least one psychoacoustic model.

10. The method of claim 1, further comprising:

performing spatial audio scene understanding based on the default audio renderings; and wherein determining the at least one audio source rendering modification further comprises determining the at least one audio source rendering modification based on the spatial audio scene understanding.

11. The method of claim 1, where determining the default audio rendering further comprises:

determining the default audio rendering based on a viewing angle associated with the user.

12. The method of claim 1, where providing the modified rendering for the at least one listening position further comprises:

performing modification of the audio rendering based on at least one further audio source which is not included in the default audio rendering for the at least two listening positions.

13. The method of claim 1, where providing the modified rendering for the at least one listening position further comprises:

adapting the modified rendering of the user based on what at least one other user is being rendered.

14. An apparatus comprising:

at least one processor; and at least one non-transitory memory including computer program code, the at least one non-transitory memory and the computer program code configured to, with the at least one processor, cause the apparatus to:

determine, for each of at least two listening positions, a default audio rendering, wherein the default audio rendering for each of the at least two listening positions includes an audio scene that a user would receive at the each of the at least two listening positions;

determine an overlap in the default audio renderings for the at least two listening positions, wherein the overlap includes at least one audio source that is included in at least two of the default audio renderings for the at least two listening positions;

determine at least one audio source rendering modification associated with at least one of the at least two listening positions based on the determined overlap; and provide a modified rendering for at least one user at the at least one listening position, where the providing of the modified rendering comprises processing the at least one audio source rendering modification so as to change a first emphasis at which the at least one audio source is rendered, where the first emphasis is changed relative to a second emphasis at which the at least one audio source is rendered with respect to at least one other of the at least two listening positions.

15. An apparatus as in claim 14, where, when determining, for each of the at least two listening positions, the default audio rendering, the at least one non-transitory memory and the computer program code are configured to, with the at least one processor, cause the apparatus to:

determine the default audio rendering in a free-viewpoint audio rendering.

16. An apparatus as in claim 14, where, when providing the modified rendering for the at least one listening position, the at least one non-transitory memory and the computer program code are configured to, with the at least one processor, cause the apparatus to:

provide a preferential rendering based on the default audio renderings, all sound sources received simultaneously with the at least two listening positions, and a relative rendering of each of the all sound sources for the at least two listening positions.

17. An apparatus as in claim 14, where when determining, for each of the at least two listening positions, the default audio rendering, the at least one non-transitory memory and the computer program code are configured to, with the at least one processor, cause the apparatus to:

determine to receive, for each of the at least two listening positions, the default audio rendering from at least one service.

18. An apparatus as in claim 14, where the at least one non-transitory memory and the computer program code are further configured to, with the at least one processor, cause the apparatus to:

determine the default audio rendering based on a security monitor system for a site.

19. An apparatus as in claim 14, where, when providing the modified rendering for the at least one listening position, the at least one non-transitory memory and the computer program code are configured to, with the at least one processor, cause the apparatus to:

provide the at least one audio source rendering modification to include an audio balance across the at least two listening positions that covers a largest portion of a complete audio scene with localization and separation of events of interest.

20. A non-transitory program storage device readable with a machine, tangibly embodying a program of instructions executable with the machine for performing operations, the operations comprising:

determining, for each of at least two listening positions, a default audio rendering, wherein the default audio rendering for each of the at least two listening positions includes an audio scene that a user would receive at the each of the at least two listening positions;

determining an overlap in the default audio renderings for the at least two listening positions, wherein the overlap includes at least one audio source that is included in at least two of the default audio renderings for the at least two listening positions;

determining at least one audio source rendering modification associated with at least one of the at least two listening positions based on the determined overlap; and providing a modified rendering for at least one user at the at least one listening position, where the providing of the modified rendering comprises processing the at least one audio source rendering modification so as to change a first emphasis at which the at least one audio source is rendered, where the first emphasis is changed relative to a second emphasis at which the at least one audio source is rendered with respect to at least one other of the at least two listening positions.

* * * * *